US007703824B2

(12) United States Patent
Kittelson et al.

(10) Patent No.: US 7,703,824 B2
(45) Date of Patent: Apr. 27, 2010

(54) IN-CAB REFRIGERATOR MOUNTING AND METHOD

(75) Inventors: Robert C. Kittelson, Fort Wayne, IN (US); Stan Tarala, Emmett, MI (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 345 days.

(21) Appl. No.: 11/949,113

(22) Filed: Dec. 3, 2007

(65) Prior Publication Data

US 2009/0140537 A1 Jun. 4, 2009

(51) Int. Cl.
*F25D 23/10* (2006.01)
*B60P 3/20* (2006.01)
*A47B 9/06* (2006.01)

(52) U.S. Cl. ..... 296/24.35; 312/401; 62/297; 248/179.1; 248/205.1; 248/346.01

(58) Field of Classification Search ..... 296/24.3, 296/24.35, 24.34, 24.36, 24.37, 24.41; 248/176.1, 248/200, 201, 205.1, 220.1, 346.01; 312/204, 312/401; 62/297
See application file for complete search history.

(56) References Cited

U.S. PATENT DOCUMENTS

| | | | | |
|---|---|---|---|---|
| 3,856,248 | A * | 12/1974 | Labelle | 248/188.2 |
| 4,331,312 | A * | 5/1982 | LaVoe | 248/201 |
| 5,897,181 | A * | 4/1999 | Avendano et al. | 312/401 |
| 5,967,634 | A * | 10/1999 | Baca | 312/242 |
| 6,360,422 | B1 * | 3/2002 | Kam | 29/525.11 |
| 7,533,917 | B2 * | 5/2009 | Tong et al. | 296/24.3 |
| 2008/0011006 | A1 * | 1/2008 | Luisi et al. | 62/259.1 |
| 2008/0127456 | A1 * | 6/2008 | Maunsell et al. | 16/400 |

* cited by examiner

*Primary Examiner*—Patricia L Engle
(74) *Attorney, Agent, or Firm*—Jeffrey P. Calfa; Mark C. Bach

(57) ABSTRACT

The interior of a truck cab (29) has a cabinet (28) that houses a refrigerator (20). The refrigerator is inserted into the interior of the cabinet by sliding it through a frontal opening in the cabinet. A mounting system that includes several parts (36, 38, 40, 42) locates and secures the refrigerator in place.

16 Claims, 7 Drawing Sheets

IN-CAB REFRIGERATOR MOUNTING AND METHOD

FIELD OF THE INVENTION

This invention relates to mounting a refrigerator in a cabinet that is inside an occupant compartment of a vehicle such as the cab of a large truck.

BACKGROUND OF THE INVENTION

Some large highway trucks have what are sometimes called sleeper cabs that provide sleeping accommodation for one or more persons in a sleeping area located behind driver and passenger seats. The sleeping area may be equipped with various accessories that provide useful conveniences during long haul runs. One such accessory is a small refrigerator that includes a refrigeration system for keeping the interior of the refrigerator and its contents cold.

Because its mass is not insignificant due to the presence of refrigeration equipment, such a refrigerator must be secured to the cab in a suitable manner so that it can withstand forces acting on it while the truck is traveling over the road, including specified forces that are might be imposed on it in the event of a crash.

Because available space is typically at a premium inside the sleeper area, a refrigerator may be housed inside a cabinet. Because the cabinet will present the outward appearance of the refrigerator, the appearance of the refrigerator casing is essentially unimportant, and that allows the cost of the refrigerator to be minimized. A door cover of suitable outward appearance may still be attached over the front of the refrigerator door to provide desired coordination with the cabinet.

In order for the cabinet to be mounted in a manner that can comply with relevant specifications regarding loading, the cabinet may have to be essentially permanently mounted. Such mounting may be facilitated or perhaps even made possible only if the refrigerator is left out while the cabinet is being attached to cab structure.

After the cabinet has been mounted, it is still necessary to mount the refrigerator inside the cabinet, and in the presence of limited space, that task may prove difficult and inefficient for production vehicle build.

Even if the refrigerator were assembled into the cabinet prior to mounting the cabinet in a vehicle, manipulation of the assembly would be more difficult because of the weight that the refrigerator adds.

SUMMARY OF THE INVENTION

Consequently, the present invention is directed to a mounting arrangement that provides a convenient and efficient method for installing a refrigerator unit in a cabinet that has already been installed in a truck cab. The cab floor bears the weight of the refrigerator unit. In conjunction with a frame of the cabinet structure, the mounting arrangement enables the installed unit to comply with relevant loading specifications. The finished installation presents the appearance of quality because of the inherent true fit of the unit to the cabinet opening that leaves only narrow gaps of substantially uniform widths between the refrigerator and the cabinet.

One generic aspect of the invention relates to a vehicle occupant compartment comprising a cabinet having an interior within which a refrigerator is disposed and which has an open front through which the refrigerator is removable from and insertable into the cabinet interior.

The refrigerator comprises a casing and a door that is disposed at the open front of the cabinet to provide access to the interior of the casing. A mounting locates the casing relative to the open front of the cabinet.

The mounting comprises a horizontal platform on which a bottom wall of the casing rests and which is spaced above a floor of the occupant compartment to provide underlying support of the refrigerator on the occupant compartment floor. A first vertical flange is disposed frontally of and below the platform in fixed spatial relation to the open front of the cabinet. A second vertical flange is affixed to the refrigerator casing and abutted with the first vertical flange. One or more fasteners fasten the two flanges together. Brackets fastened to opposite side walls of the casing are fastened by one or more fasteners to the cabinet.

Another generic aspect of the invention relates to a method of installing a refrigerator in a cabinet that is inside a vehicle occupant compartment.

The method comprises: disposing the refrigerator frontally of and in substantial registration with a frontal opening in the cabinet so that a door at a front of the refrigerator faces away from the frontal opening in the cabinet, moving the refrigerator rearward through the frontal opening into an interior of the cabinet while elevating a rear of the refrigerator high enough to allow a bottom wall of the refrigerator to rest on a horizontal platform that is inside the cabinet interior and elevated above a floor of the cab, and continuing to move the refrigerator rearward by sliding it along the platform until further movement is arrested by mutual abutment of a part that is disposed in fixed spatial relation to the cabinet and a part that is fixedly mounted on the refrigerator.

The mutual abutment places the door substantially in a vertical plane that is parallel with a vertical plane that defines the frontal opening and at the same time places holes in brackets that are attached to the refrigerator and that confront opposite vertical sides of the frontal opening in registry with holes in those vertical sides.

Thereafter, fasteners are installed to fasten the brackets to the sides of the frontal opening and to fasten the abutted parts together.

The foregoing, along with further features and advantages of the invention, will be seen in the following disclosure of a presently preferred embodiment of the invention depicting the best mode contemplated at this time for carrying out the invention. This specification includes drawings, now briefly described as follows.

BRIEF DESCRIPTION OF THE DRAWINGS

FIG. 6 is a perspective view of the parts of FIGS. 4 and 5 preparatory to being connected to each other.

DESCRIPTION OF THE PREFERRED EMBODIMENT

Figure 1:
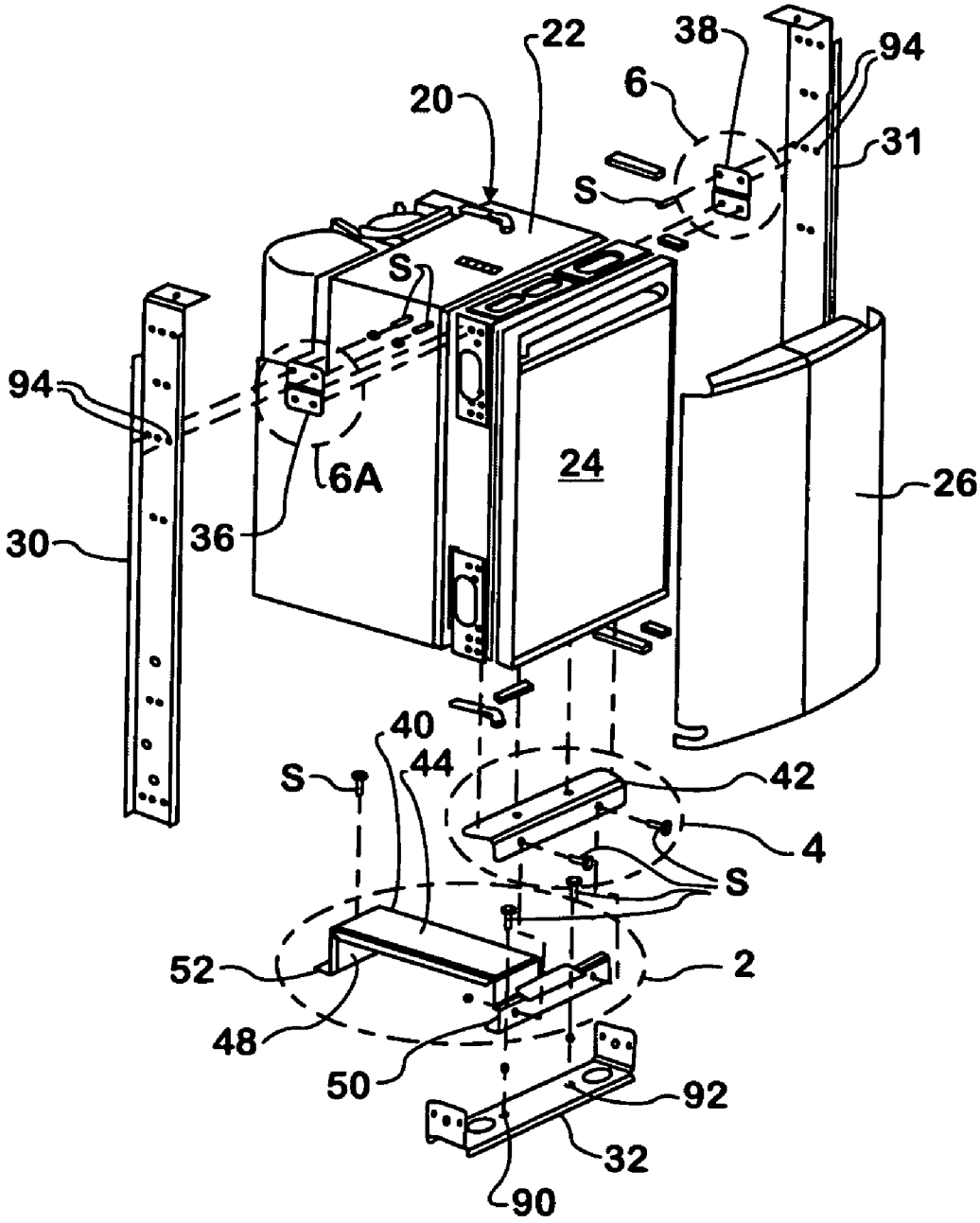
FIG. 1 is an exploded perspective view of a refrigerator unit and associated parts for enabling the unit to be conveniently slid into and accurately located within the interior of an in-cab cabinet and then securely attached in accordance with principles of the invention.
Figure 13:
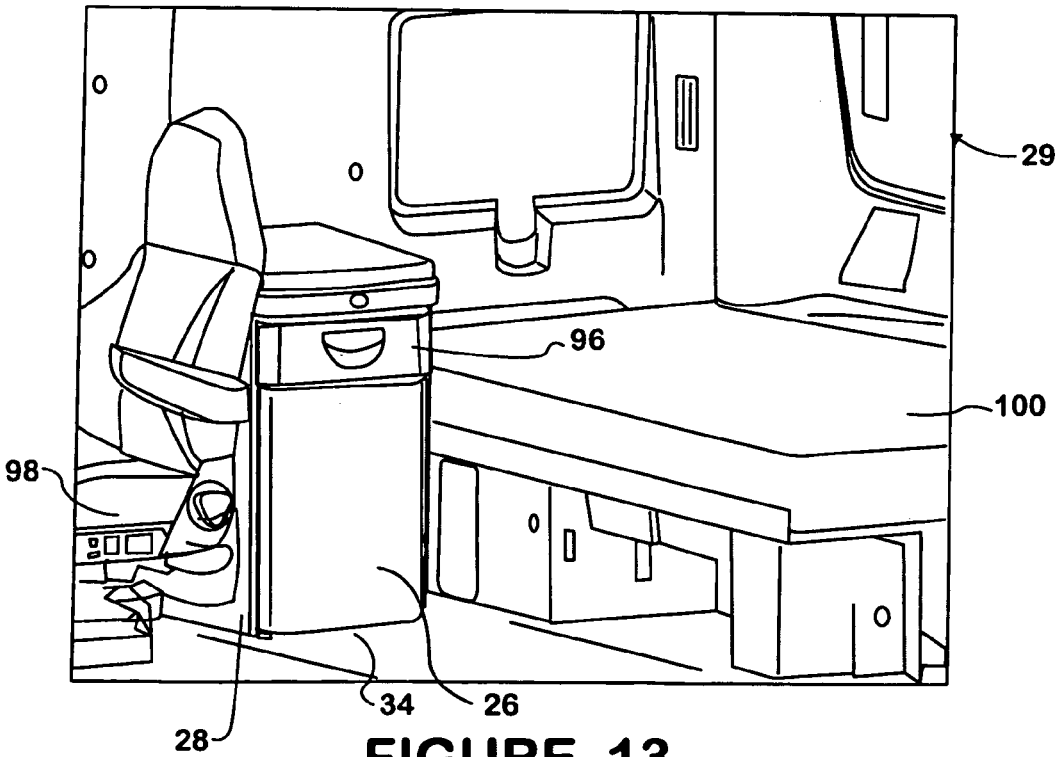
FIG. 13 is a perspective view of the cab interior showing the finished installation.

FIG. 1 shows a refrigerator unit 20 that comprises a casing 22 having a top wall, bottom wall, back wall, and two side walls that provide a frontal opening into the casing interior. A rectangular door 24 is hinged on casing 22 for swinging about a vertical axis along one vertical side of the frontal opening to open and close the opening. A door finish cover 26 is attached to the front of door 24 so that when unit 20 is installed in a cabinet 28 in a truck cab 29, as shown in FIG. 13, the finish cover cooperates with the cabinet to present the appearance of a quality product characterized by precise fit of the door finish cover to the cabinet.

Cabinet 28 comprises a framework that supports the top and side walls. The back of the cabinet may be open and abutted against a side of cab 29. Three parts of that framework are utilized in the mounting of unit 20. They are upright frame members 30, 31 that are at respective vertical sides of the frontal opening of cabinet 28 and a horizontal bottom frame member 32 that bridges the bottom ends of members 30, 31. The cab floor 34 is utilized for supporting cabinet 28 and the refrigerator unit's weight when the unit is installed in the cabinet, as will be further explained.

Figure 2:
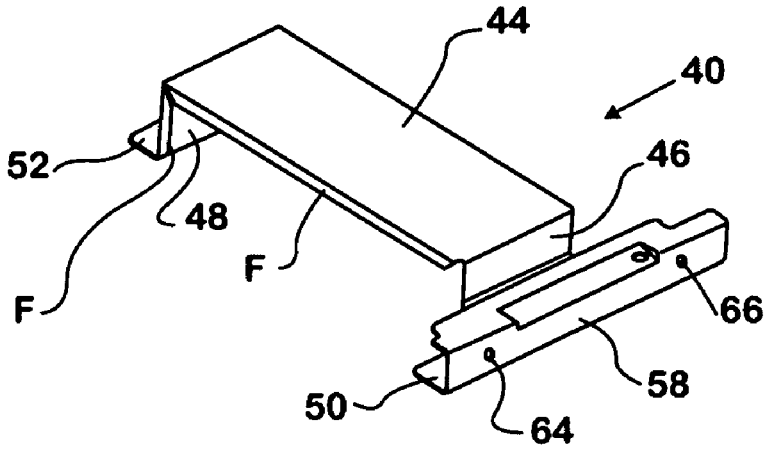
FIG. 2 is an enlarged view of a stamped metal part that appears within circle 2 in FIG. 1.
Figure 4:
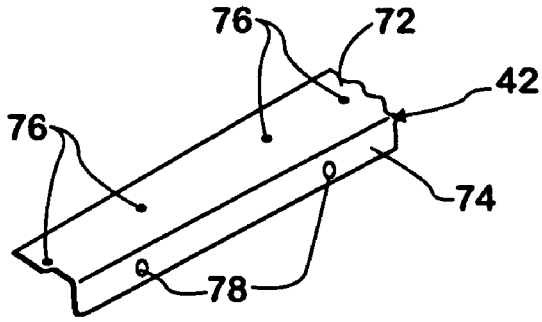
FIG. 4 is an enlarged view of the part that appears within circle 4 in FIG. 1.

Upper side brackets 36, 38, a lower floor bracket 40, and a lower stop bracket 42 are additional mounting parts that interface the unit to the cabinet and the cab floor. Bracket 38 is shown by itself in FIG. 6 while brackets 40 and 42 are shown by themselves in FIGS. 2 and 4 respectively.

Lower floor bracket 40 is fastened to cab floor 34 and to frame member 32 by a number of screws S. The construction of bracket 40 is best explained with reference to FIGS. 1, 2, 3, and 9.

Bracket 40 is a one-piece metal stamping formed to provide a horizontal, rectangular-shaped, slide platform 44 that is supported vertically above cab floor 34 via vertical support legs 46, 48 at front and back ends. Legs 46, 48 are themselves supported on floor 34 via respective feet 50, 52 that are disposed horizontally beyond the ends of platform 44. The feet comprise holes, such as holes 54, 56 in foot 50, through which screws S are passed for threading into member 32 and floor 34 respectively and tightening to secure bracket 40 in place. Foot 52 is directly attached to floor 34. Foot 50 is attached directly to member 32, which in rests directly on floor 34. The sides of platform 44 and of leg 48 have stiffening flanges F.

Foot 50 has a different shape from that of foot 52 because of a frontal extension of its area that rests on member 32. At the front of the extended area is a vertical flange 58 that is noticeably wider (meaning in the direction of the cabinet's width) than the width of platform 44. At the top of flange 58, two tabs 60, 62 are bent horizontally inward toward leg 46 at widthwise ends of the flange.

Below each tab 60, 62 about halfway toward foot 50, flange 58 contains a respective through-hole 64, 66. A respective weldnut 68, 70 is affixed to the inside face of flange 58 at each through-hole 64, 66.

The construction of lower stop bracket 42 is best explained with reference to FIGS. 1, 4, 5, and 9. Bracket 42 is a stamped metal part that comprises a horizontal mounting flange 72 and a vertical stop flange 74 that is bent downward along the front of flange 72. There are four through-holes 76 in flange 72 and two through-holes 78 in flange 74.

Figure 6:
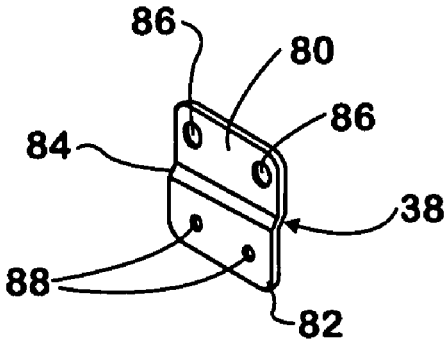
FIG. 6 is a perspective view of the part that appears within circle 6 in FIG. 1. The part shown in circle 6A in FIG. 1 is identical, but arranged symmetrically opposite to the one in circle 6.

The construction of side brackets 36, 38 is best explained with reference to FIGS. 1, 6, and 7. Each side bracket is a stamped metal part that comprises upper and lower vertical mounting flanges 80, 82 that are parallel and horizontally offset from each other by a curved bend 84. There are two through-holes 86 in flange 80 and two through-holes 88 in flange 82.

Figure 5:
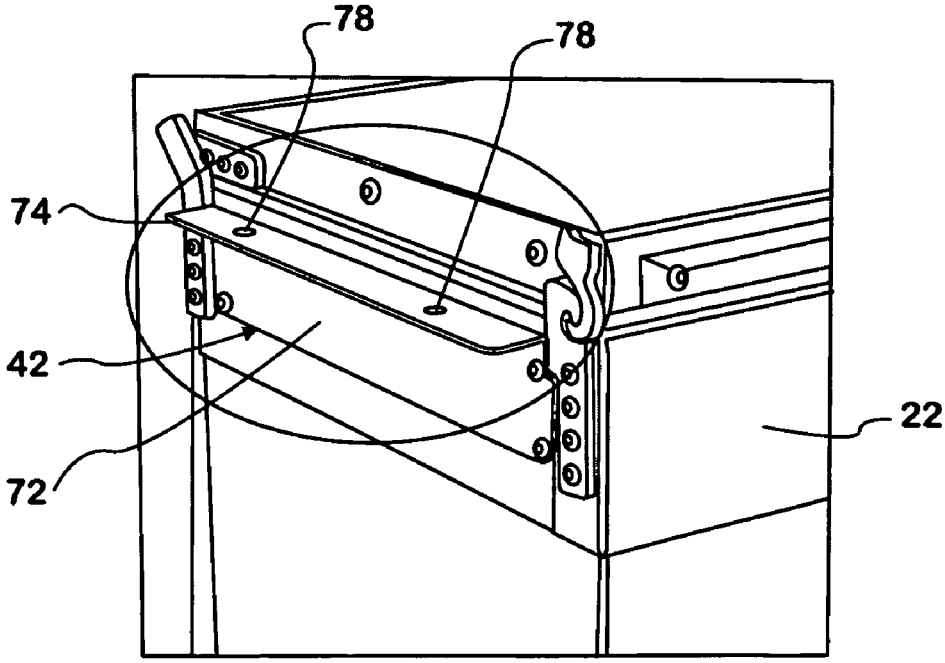
FIG. 5 is a perspective view of the part shown in FIG. 4 mounted on the refrigerator unit.
Figure 7:
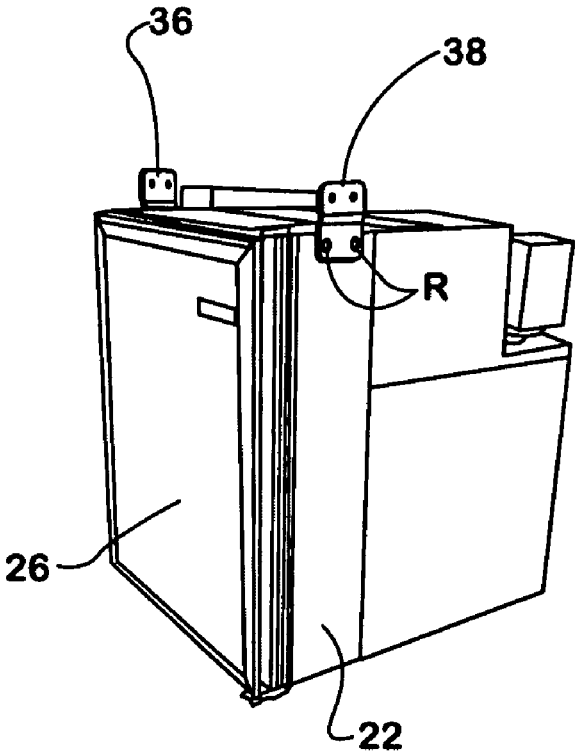
FIG. 7 is a perspective view of the refrigerator unit with the parts in circles 6 and 6A attached to the unit.

Prior to installing unit 20 into cabinet 28, brackets 36, 38, and 42 are fastened to casing 22, as shown by FIGS. 1, 5, and 7.

With each flange 80 of brackets 36, 38 disposed vertically above and laterally outboard of the respective casing side wall, flanges 82 of brackets 36, 38 are disposed flat against the casing side walls proximate the upper front corners of the latter and fastened to the casing, preferably by using rivets R.

With flange 74 of bracket 42 disposed toward the front and directed downward, flange 72 is disposed flat against the casing bottom wall proximate the front of the casing and fastened to the casing, preferably using rivets R.

Figure 3:
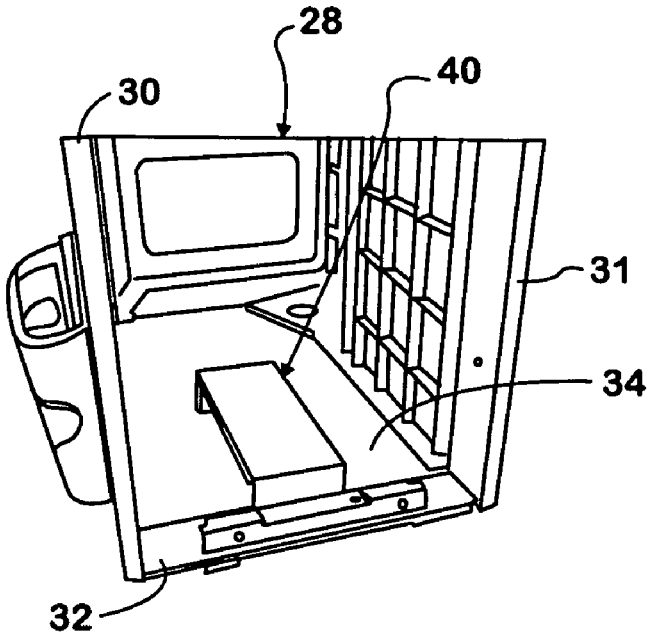
FIG. 3 is a perspective view of the part shown in FIG. 2 mounted inside the cabinet interior.

Prior to installing unit 20 into cabinet 28, bracket 40 is fastened to floor 34 and frame member 32, as shown by FIGS. 1 and 3. Foot 50 is placed on a horizontal surface of member 32 with holes 54 and 56 in registration with holes 90, 92 on that surface of member 32. Foot 50 is fastened in place using headed screws S whose threaded shanks are passed through holes 54, 56 and tightened in holes 90, 92 to secure leg 46 to member 32. A through-hole in foot 52 registers with a hole in floor 34, and a screw S is passed through it and tightened in the hole in floor 34 to secure leg 48 to the floor. With bracket 40 fastened as described, flange 58 is perpendicular to the side walls of the cabinet.

Unit 20 is now ready to be installed. It is placed frontally of the open front of cabinet 28 and aligned with the cabinet opening. With the rear of casing 22 elevated, the unit is moved into the cabinet interior so that the rear of the casing bottom wall can rest on platform 44. This allows the casing to be slid rearward on the platform, preferably while the front is being lifted off floor 34 so that the edge of flange 74 doesn't scrape on the floor, while the platform increasingly bears the weight of the unit as the latter is slid farther rearward (see FIG. 11).

The unit continues to be slid until stop flange 74 abuts flange 58 (see FIGS. 9 and 12) to arrest further sliding. With flanges 74 and 58 mutually abutted along their widths, casing 22 is aligned true to the interior of the cabinet and is not cocked at an angle. The mutual abutment places door 24 substantially in a vertical plane that is parallel with a vertical plane that defines the frontal opening of the cabinet.

During the final increment of sliding, widthwise centering of the casing is assured by the presence of brackets 36, 38. If the casing is not centered widthwise of the cabinet, one of the brackets will hit the corresponding upright member 30, 31 and therefore prevent the casing from being fully inserted.

Figure 8:
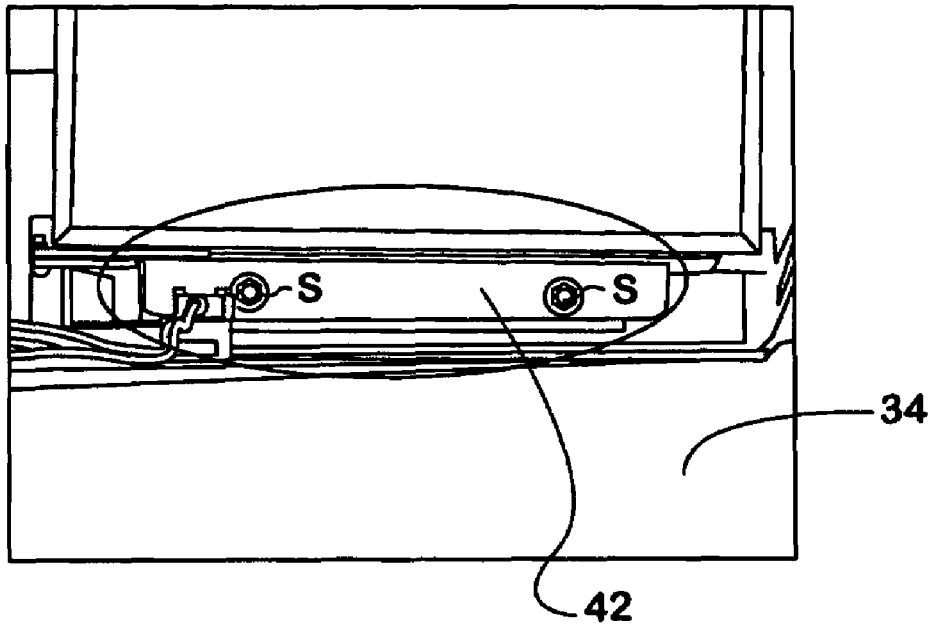
FIG. 8 is a front elevation view of the lower portion of the unit after installation and attachment.
Figure 9:
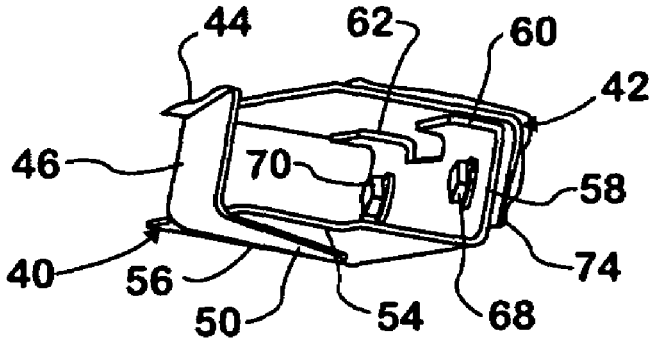
FIG. 9 is a fragmentary perspective view showing detail of the attachment shown in FIG. 8 from a different direction.
Figure 10:
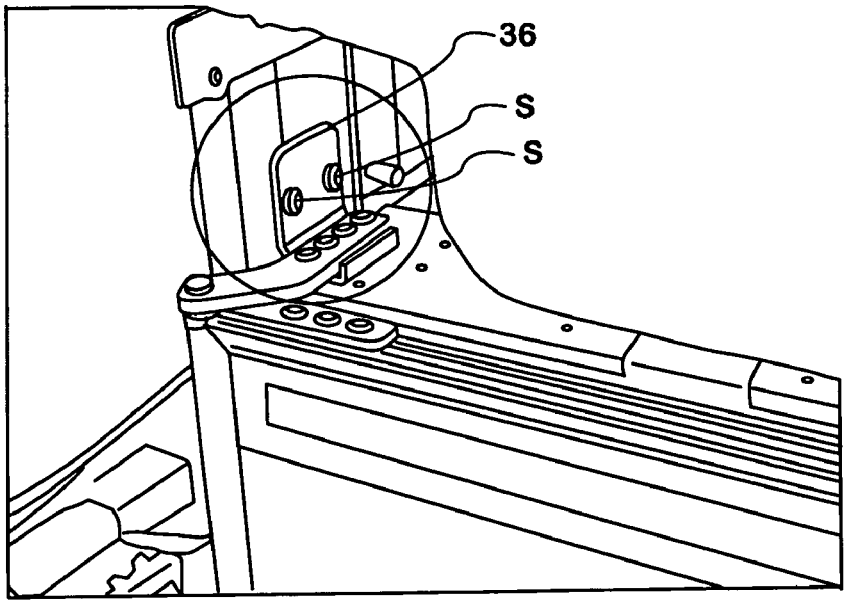
FIG. 10 is a perspective view of the upper left front corner of the unit after installation and attachment.
Figure 11:
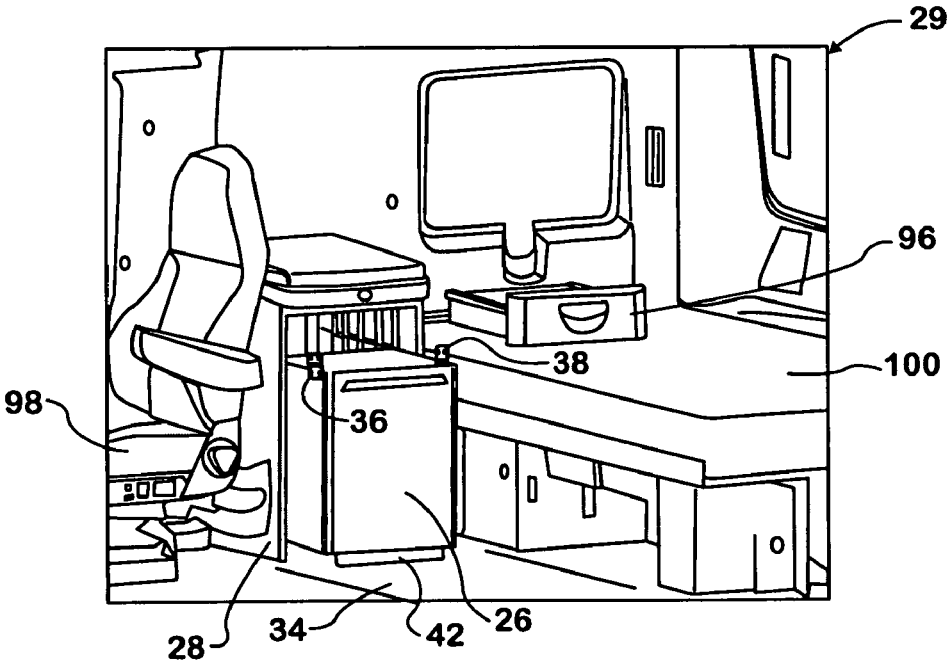
FIG. 11 is a perspective view of some of the cab interior with the unit partially inserted into the cabinet interior.
Figure 12:
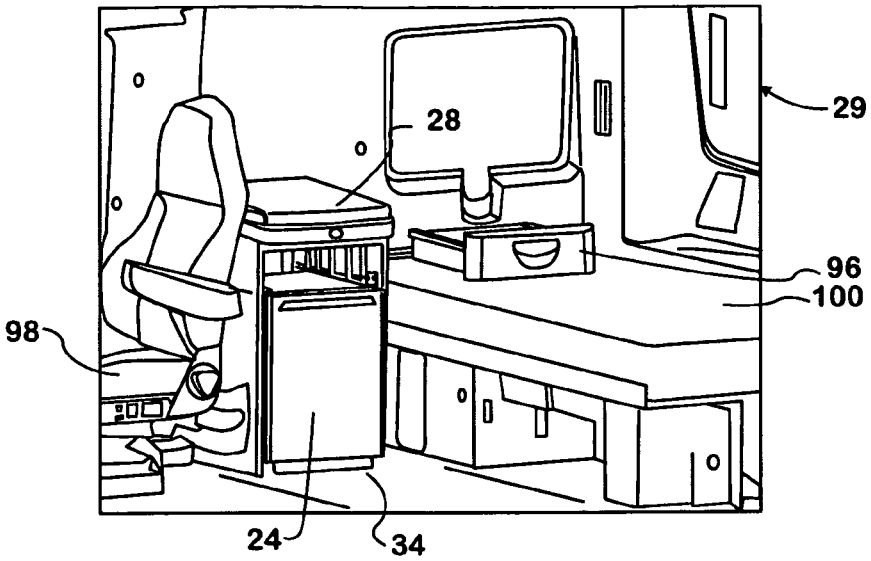
FIG. 12 is a perspective view of the cab interior after the unit has been fully inserted into the cabinet interior.

With casing 22 fully inserted, holes 86 in brackets 36, 38 register with holes 94 in members 30 and 31, and holes 78 in bracket 42 register with weldnuts 68, 70. Screws S are passed through the points of registry and tightened to complete the mounting (see FIGS. 8 and 10). FIG. 12 shows that access for fastening brackets 36, 38 to the cabinet frame is provided because a drawer 96 that fits into space above unit 20 does not yet occupy that space. Once the mounting is complete, the drawer can be slid into that space. If the casing was inserted into cabinet 28 without door cover 26 being attached to the door, as shown by FIG. 11, door cover 26 is attached to door 24 after the casing has been mounted in the cabinet to provide the finished appearance that can be seen in FIG. 13 where the front face of the door cover is in substantial alignment with the front face of the drawer when both door and drawer are closed. The door cover can be attached to the door before the casing is inserted into the cabinet.

Cabinet 28 is secured to the cab-in-white during the truck assembly process in a manner that provides compliance with relevant loading specifications, including those that might be encountered in the event of a crash. Accordingly, it may be inconvenient, unsuitable, or perhaps even impossible for unit 20 to be assembled into the cabinet before the cabinet is mounted in the cab. The mounting brackets that have been described here provide a convenient method for installing unit 20 into cabinet 28 with the cabinet already installed in the cab. The use of cab floor 34 to bear the weight of the unit in conjunction with the frame of the cabinet structure enable the unit to also comply with relevant loading specifications. Moreover, the finished installation presents a quality appearance because of the true fit of the unit to the cabinet opening.

In the finished cab, cabinet 28 is behind the passenger seat 98 and in front of a bed 100 whose length is perpendicular to the fore-aft direction of the truck. Unit 20 can be installed and removed with seat 98 in place, but during truck build, it may be more convenient to install the unit before seat 98 is mounted on the floor.

While a presently preferred embodiment of the invention has been illustrated and described, it should be appreciated that principles of the invention apply to all embodiments falling within the scope of the following claims.

What is claimed is:

1. A vehicle occupant compartment comprising a cabinet having an interior within which a refrigerator is disposed and which has an open front through which the refrigerator is removable from and insertable into the cabinet interior, the refrigerator comprising a casing and a door that is disposed at the open front of the cabinet to provide access to the interior of the casing, and a mounting for locating the casing relative to the open front of the cabinet, the mounting comprising a horizontal platform on which a bottom wall of the casing rests and which is spaced above a floor of the occupant compartment to provide underlying support of the refrigerator on the occupant compartment floor, a first vertical flange disposed frontally of and below the platform in fixed spatial relation to the open front of the cabinet, a second vertical flange affixed to the refrigerator casing and abutted with the first vertical flange, one or more fasteners fastening the two flanges together, brackets fastened to opposite side walls of the casing, and one or more fasteners fastening each of the brackets to the cabinet.

2. A vehicle occupant compartment as set forth in claim 1 wherein the first vertical flange and the horizontal platform are respective portions of a single metal stamping.

3. A vehicle occupant compartment as set forth in claim 2 wherein the single metal stamping further comprises front and rear support legs at respective front and rear ends of the platform.

4. A vehicle occupant compartment as set forth in claim 3 wherein the front support leg has a foot that extends frontally of the front support leg, and the first vertical flange extends upwardly from a front terminus of the foot.

5. A vehicle occupant compartment as set forth in claim 4 wherein the rear support leg has a foot that is directly fastened to the floor by a fastener, and the foot of the front support leg is fastened to a frame member of the cabinet by one or more fasteners.

6. A vehicle occupant compartment as set forth in claim 1 wherein the brackets are fastened to members of a frame of the cabinet by respective fasteners.

7. A vehicle occupant compartment as set forth in claim 6 wherein each bracket comprises upper and lower vertical mounting flanges that are parallel and horizontally offset from each other by a curved bend, and the upper mounting flange is disposed laterally outboard of the lower mounting flange and fastened to a respective one of the cabinet frame members.

8. A vehicle occupant compartment as set forth in claim 1 wherein the second vertical flange is a portion of a single metal stamping having a horizontal flange that extends rearward an upper terminus of the second vertical flange and that is disposed against and fastened to the bottom wall of the casing by one or more fasteners.

9. A vehicle occupant compartment as set forth in claim 1 wherein the cabinet interior comprises space that overlies a top wall of the casing, and a sliding drawer is disposed in that space for out of and into the cabinet.

10. A vehicle occupant compartment as set forth in claim 9 including a door cover disposed on the refrigerator door, a front face of the door cover being in substantial alignment with a front face of the drawer when both the door and the drawer are closed.

11. A floor-mounted cabinet having an interior within which a refrigerator is disposed and which has an open front through which the refrigerator is removable from and insertable into the cabinet interior, the refrigerator comprising a casing and a front door that is disposed at the open front of the cabinet to provide access to the interior of the casing, and a mounting for locating the casing relative to the open front of the cabinet, the mounting comprising a horizontal platform on which a bottom wall of the casing rests and which is disposed at a level higher than that at which the cabinet rests on a floor to provide underlying support of the refrigerator, a first vertical flange disposed frontally of and below the platform in fixed spatial relation to the open front of the cabinet, a second vertical flange affixed to the refrigerator casing and abutted with the first vertical flange, one or more fasteners fastening the two flanges together, brackets fastened to opposite side walls of the casing, and one or more fasteners fastening each of the brackets to the cabinet.

12. A method of installing a refrigerator in a cabinet that is inside a vehicle occupant compartment, the method comprising: disposing the refrigerator frontally of and in substantial registration with a frontal opening in the cabinet so that a door at a front of the refrigerator faces away from the frontal opening in the cabinet, moving the refrigerator rearward through the frontal opening into an interior of the cabinet while elevating a rear of the refrigerator high enough to allow a bottom wall of the refrigerator to rest on a horizontal platform that is inside the cabinet interior and elevated above a floor of the cab, continuing to move the refrigerator rearward by sliding it along the platform until further movement is arrested by mutual abutment of a part that is disposed in fixed spatial relation to the cabinet and a part that is fixedly mounted on the refrigerator, the mutual abutment placing the door substantially in a vertical plane that is parallel with a vertical plane that defines the frontal opening and at the same time placing holes in brackets that are attached to the refrigerator and that confront opposite vertical sides of the frontal opening in registry with holes in those vertical sides.

13. A method as set forth in claim 12 including fastening the brackets to the vertical sides of the frontal opening by passing fasteners through the holes in the brackets and into the holes in the vertical sides of the frontal opening.

14. A method as set forth in claim 13 including fastening the mutually abutted parts together.

15. A method as set forth in claim 12 including mounting a door finish cover over the refrigerator door.

16. A method as set forth in claim 15 including inserting a sliding drawer into a space within the cabinet interior that is above the refrigerator.

* * * * *